US009457943B1

(12) United States Patent
Patel

(10) Patent No.: US 9,457,943 B1
(45) Date of Patent: Oct. 4, 2016

(54) BUNDLING PANS WITH A TAPE HANDLE

(71) Applicant: Handi-Foil Corporation, Wheeling, IL (US)

(72) Inventor: Raj Patel, Lake Zurich (IL)

(73) Assignee: Handi Foil Corporation, Wheeling, IL (US)

( * ) Notice: Subject to any disclaimer, the term of this patent is extended or adjusted under 35 U.S.C. 154(b) by 0 days.

(21) Appl. No.: 15/099,702

(22) Filed: Apr. 15, 2016

(51) Int. Cl.
*B65D 71/00* (2006.01)
*B65D 63/10* (2006.01)
*A47J 37/01* (2006.01)

(52) U.S. Cl.
CPC ..... *B65D 63/1009* (2013.01); *A47J 37/01* (2013.01)

(58) Field of Classification Search
USPC ..... 206/499, 216, 223, 541, 546, 577; 220/752, 754, 756, 758, 755, 759, 760
See application file for complete search history.

(56) References Cited

U.S. PATENT DOCUMENTS 2,603,409 A 7/1952 Crary
2,851,211 A 9/1958 Bergstein
2,918,206 A 12/1959 Kleingers, Jr
3,031,359 A 4/1962 Blank
4,234,091 A * 11/1980 Koch ..... B65D 21/0233 206/499
4,269,322 A * 5/1981 Larson ..... B65D 23/003 215/397
4,396,128 A * 8/1983 Larson ..... A45F 5/10 215/399
4,418,864 A 12/1983 Nielsen
4,505,506 A * 3/1985 Picozza ..... A45F 3/46 206/503
5,048,687 A * 9/1991 Suzuki ..... B65D 71/10 206/494
5,079,900 A 1/1992 Pinckney et al.
5,080,281 A 1/1992 Seabold
5,293,999 A 3/1994 Linngren
6,269,949 B1 * 8/2001 Gottlieb ..... B65D 1/265 206/519
8,496,112 B2 * 7/2013 Sarnoff ..... B65D 81/343 206/223
8,960,470 B2 * 2/2015 Tarble ..... B65D 77/0453 206/507
2007/0045138 A1 * 3/2007 Schweitz ..... A45C 7/009 206/315.1
2016/0090211 A1 * 3/2016 Bateman ..... A47G 23/0216 220/758

* cited by examiner

*Primary Examiner* — Jacob K Ackun
(74) *Attorney, Agent, or Firm* — Adam K. Sacharoff; Much Shelist

(57) ABSTRACT

In summary there is provided in one embodiment a a bundle of pans and a handle. The handle has opposed adhesive ends and an un-adhesive portion between the two adhesive ends. The adhesive sections extend such that each adhesive section lies over at least a section of an opposing pan side defined on outside surfaces of the lower most pan and a height defined by the rims of the bundle of pans. The un-adhesive portion of the handle rests at least along a portion of the opposing uppermost sidewalls of the uppermost pan and the bottom base of the uppermost pan and is configured to act as a handle when pulled taut.

7 Claims, 3 Drawing Sheets

BUNDLING PANS WITH A TAPE HANDLE

FIELD OF THE INVENTION

The present invention relates to pans and more particularly to disposable baking and aluminum roasting pans and the ability to bundle the pans together for point of sale displays.

BACKGROUND OF THE INVENTION

Baking and roasting pans otherwise referred to herein generally as pans, have long been used to cook, re-heat, and store food. These pans which are typically sold in groups of 2-3 and sometimes more are bundled together. Bundling of the pans typically requires a shrink wrap plastic around the edge of the pans. The amount of plastic would depend on the number of pans bundled together. In addition, if the plastic wrap does not conform to the profile of the pans, stacking multiple bundles together could be difficult. In addition, when the bundles consist of 10 or more pans, they become difficult too bulky to carry by the consumer. As such there is a need to provide a new was to bundle the pans that also make it easy for the consumer to carry.

SUMMARY OF THE INVENTION

In accordance with the present invention there is provided in one embodiment a bundle of pans, defined by having a bottom most pan, and upper most pan and at least one pan intermediately positioned between the lower most and upper most pans. Each pan is defined by having a bottom base, a sidewall extending upwardly from the bottom base and terminating at an edge to create a well there between, an outwardly extending ridge being an extension from the sidewall edge, and the ridge further terminating at a rim extending along a periphery of the ridge. The bundle of pans further includes a handle having a predetermined length. The handle further having a pair of diametrically opposed ends that includes along each end an adhesive section on an interior facing portion of the handle, and further includes an un-adhesive portion between the two adhesive sections. The adhesive sections further extend along a portion of the predetermined length such that each adhesive section lies over at least a section of an opposing side defined on outside surfaces of the lower most pan and over a height defined by the rims of the bundle of pans. In addition, the un-adhesive portion of the handle rests at least along a portion of the opposing uppermost sidewalls of the uppermost pan and along the bottom base of the uppermost pan and is configured to act as a handle when pulled taut.

In another aspect, the adhesive section may further extend along the portion of the predetermined length such that each adhesive section further lies over a portion of the ridge of the upper most pan and/or a portion of the opposing uppermost sidewalls. In other aspects, the un-adhesive portion of the handle include an indicia portion to convey information.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
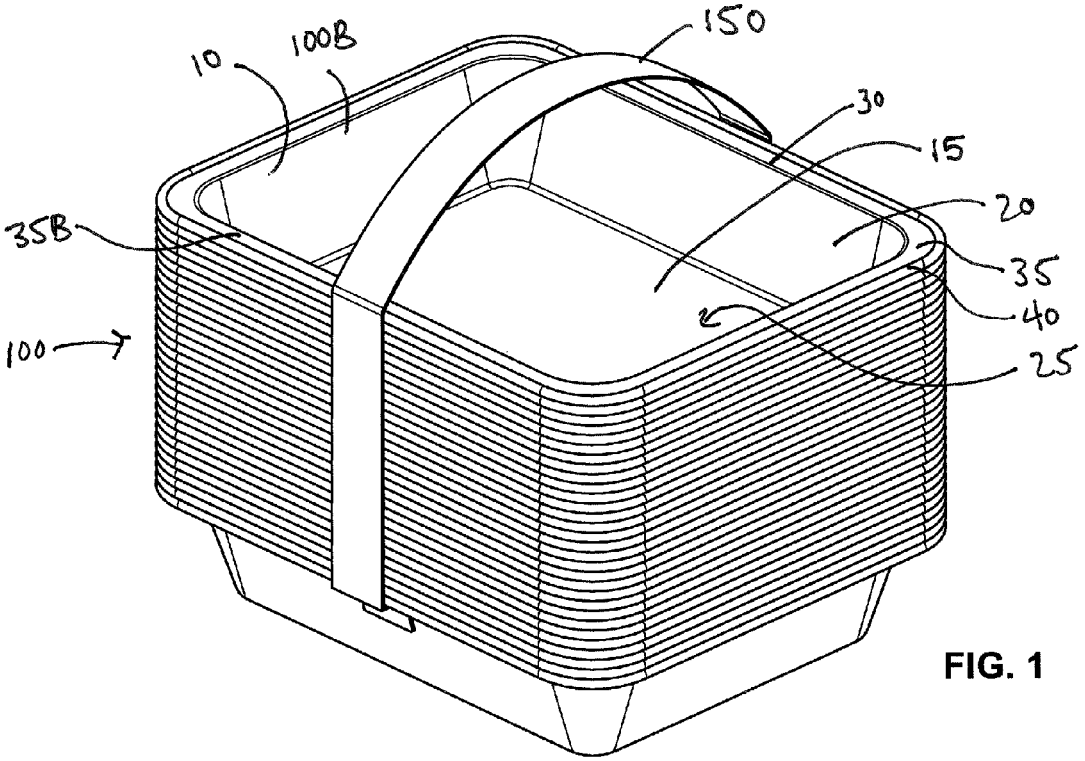
FIG. 1 is a perspective view of a bundle of pans with a tape handle in accordance with one embodiment of the present invention showing the handle taut.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
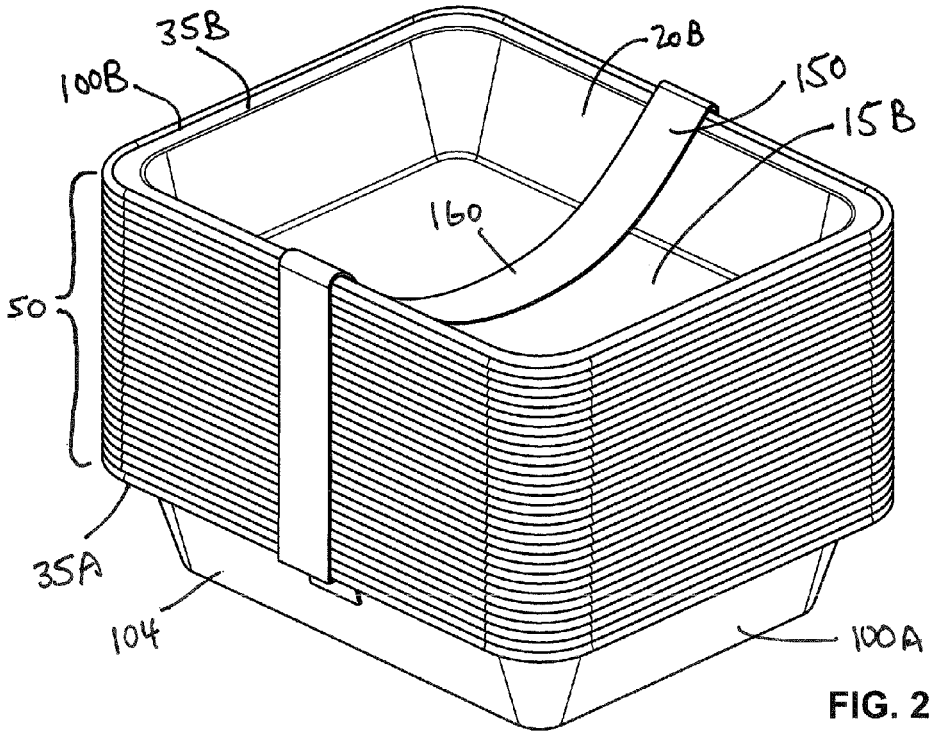
FIG. 2 is a perspective view of a bundle of pans with a tape handle in accordance with one embodiment of the present invention showing the handle resting in the upper most pan.
Figure 3:
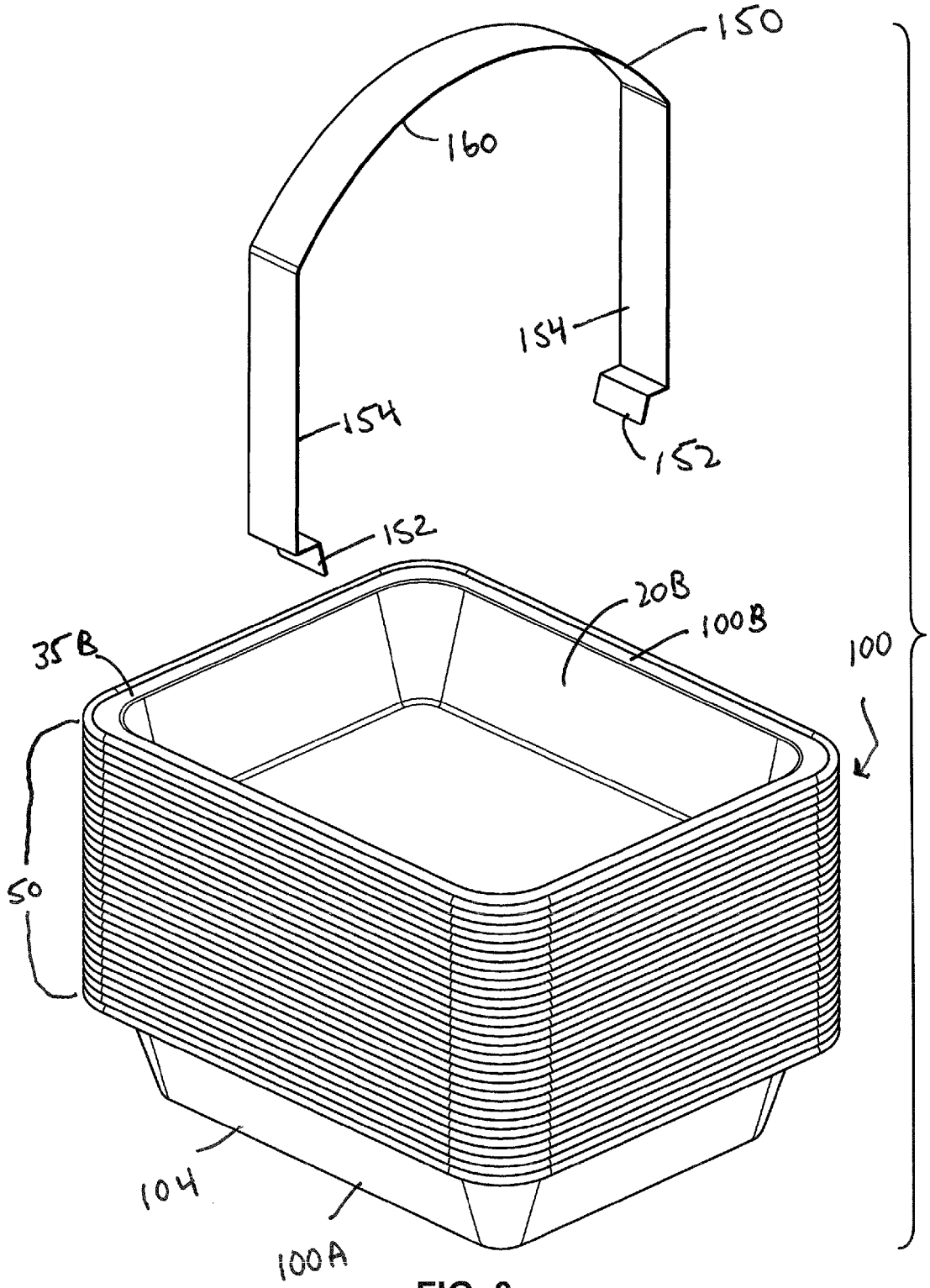
FIG. 3 is an exploded view of the handle from the bundle of pans.
Figure 4:
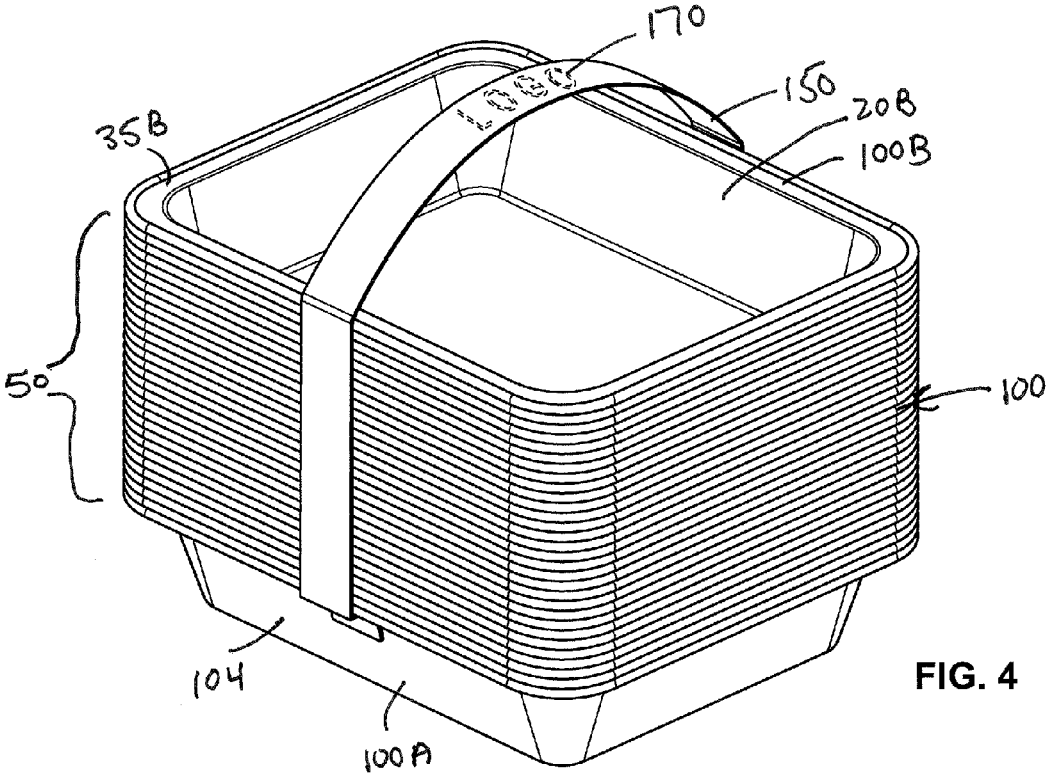
FIG. 4 is a perspective view of a bundle of pans with a tape handle showing the handle with indicia.
Figure 5:
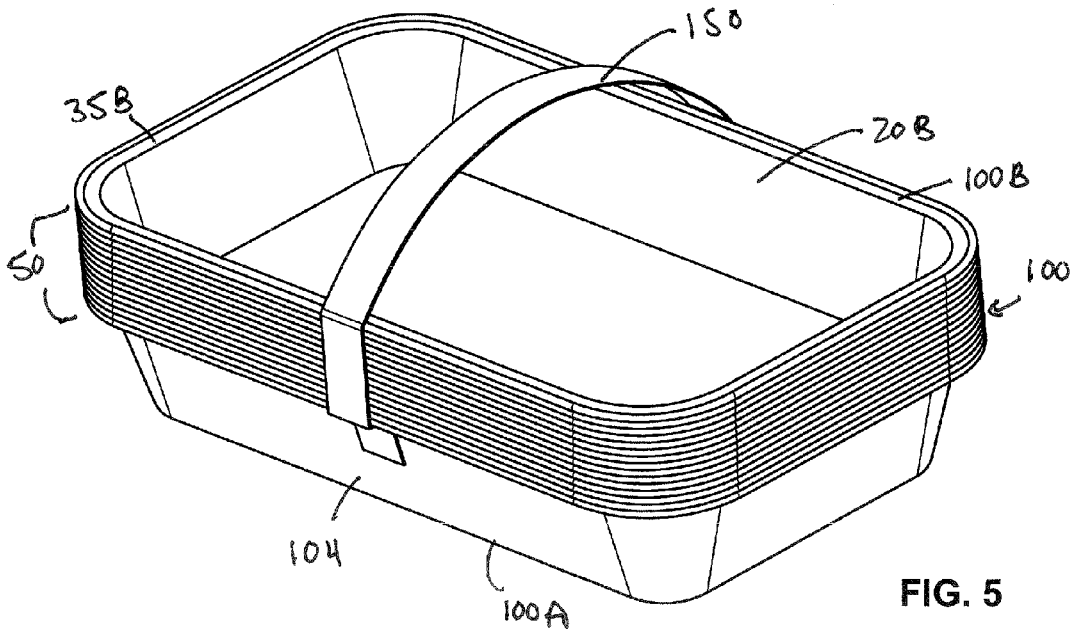
FIG. 5 is a perspective view of another bundle of pans with a tape handle in accordance with one embodiment of the present invention.

With reference to FIGS. 1-5 there is provided a plurality of pans 100, identically defined and individually references as 10, used for baking, roasting, or simply used for preparing, serving, and storing meals. Each pan 10 includes a bottom base 15 terminated to a bottom edge that meets with a sidewall 20. The sidewall may be a single continuous sidewall or be sectioned into various sides (i.e. front, rear, left, right, or angled sides). Therefore the shape of the pan may be changed into various geometrically shapes, such as but not limited to a square, rectangle, circle or oval, or other symmetrical polygonal shape. The sidewall 20 extends upwardly forming a depression or well 25 for which food can be placed and which substantially surrounds the entire bottom base 15. The sidewall 20 terminates at an edge 30 where it meets and forms into an outwardly extending ridge 35. The ridge 35 further terminates into a rim 40 away from the sidewall 20.

When bundled, the pans 100 include a bundle height 50 that can be measured as the height of the bundled rims 40 when stacked together. In addition, the pans 100 when bundled have a lower most pan 100A with opposing side outside surfaces 104 that is below the lower most ridge 35A and have an upper most pan 100B with a ridge 35B, opposing uppermost sidewalls 20B and a bottom base 15B.

To overcome the problems in the prior art, the pans 100 can be bundled with a handle 150 that is secured to the bundled pans 100 in a manner that keeps all of the pans 100 secured together but further acts as a handle for a consumer to lift and use for carrying the bundled pans 100.

The handle 150 which may be a strip of material defined at a predetermined length. The handle 150 includes a pair of diametrically opposed ends 152 that includes along each end 152 an adhesive section 154 on the underside of the handle. The adhesive section(s) 154 may be positioned only about opposed portions of the handle near or adjacent to the opposed ends 152. This leaves an un-adhesive portion 160 positioned between the two adhesive sections 154.

The adhesive sections 154 may be defined to cover a portion of the handle 150 and include a length that is substantially equal to the length of at least (1) a section of the opposing side outside surfaces 104 of the lower most pan

100A and (2) the height 50 of the bundled rims 40. In other aspects the adhesive sections 154 may extend to also cover a portion of (3) the ridge 35B of the upper most pan 100B, and/or (4) a portion of the opposing uppermost sidewalls 20B.

The entire length of the handle further defined to have the un-adhesive portion 160 of the handle rest at least along the (a) portion of the opposing uppermost sidewalls 20B of the uppermost pan 100B and (b) the bottom base 15B of the uppermost pan 100B. In other aspects, the un-adhesive portion 160 also covers (c) the ridge 35B of the uppermost pan and/or (d) the rim 40B of the uppermost pan. This also the un-adhesive portion 160 of the handle to rest within the uppermost pan 100B when not being used but can be pulled taut by the consumer to act as a handle since the sides have adhesive portions securing the bundle of pans together.

In addition, the un-adhesive portion 160 of the handle 150 may also include an indicia portion 170 or a portion designed to have a design, logo, advertisement, text, or other indicia used to convey information. Unlike the previous shrink wrap bundles pans, the tape handle 150 not only provides for an easy method of bundling and carrying pans, but can also convey information to the consumers such as sales, corporate information, recipes, etc.

Lastly, the adhesive portions may be easily removed and re-applied by the consumer, allowing the consumer to remove pans from the bundle but still keep the remaining pans bundled together. In the previous shrink wrap bundle pans, once the shrink wrap is removed the pans remain unbundled.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A bundle of pans, defined by having a bottom most pan, and upper most pan and at least one pan intermediately positioned between the lower most and upper most pans, each pan defined by having a bottom base, a sidewall extending upwardly from the bottom base and terminating at an edge to create a well there between, an outwardly extending ridge being an extension from the sidewall edge, the ridge further terminating at a rim extending along a periphery of the ridge, wherein the bundle of pans comprising:

a handle having a predetermined length, the handle further having a pair of diametrically opposed ends that includes along each end an adhesive section on an interior facing portion of the handle, and further includes an un-adhesive portion between the two adhesive sections, and wherein the adhesive sections extend along a portion of the predetermined length such that each adhesive section lies over at least a section of an opposing side defined on outside surfaces of the lower most pan and further lies over a height defined by the rims of the bundle of pans, and wherein the un-adhesive portion of the handle rests at least along a portion of the opposing uppermost sidewalls of the uppermost pan and further rests along the bottom base of the uppermost pan and is configured to act as a handle when pulled taut.

2. The bundle of pans of claim 1, wherein the adhesive sections are positioned about opposed portions of the handle near the opposed ends.

3. The bundle of pans of claim 1, wherein the adhesive section further extends along the portion of the predetermined length such that each adhesive section further lies over a portion of the ridge of the upper most pan and/or a portion of the opposing uppermost sidewalls.

4. The bundle of pans of claim 1, wherein the un-adhesive portion of the handle include an indicia portion to convey information.

5. A bundle of pans, defined by having a bottom most pan, and upper most pan and at least one pan intermediately positioned between the lower most and upper most pans, each pan defined by having a bottom base, a sidewall extending upwardly from the bottom base and terminating at an edge to create a well there between, an outwardly extending ridge being an extension from the sidewall edge, the ridge further terminating at a rim extending along a periphery of the ridge, wherein the bundle of pans comprising:

a handle having opposed adhesive ends and an un-adhesive portion between the two adhesive ends, the adhesive ends extend along portions of the handle such that each adhesive end lies over at least a section of opposing pan sides defined on outside surfaces of the lower most pan and over a height defined by the rims of the bundle of pans, and wherein the un-adhesive portion of the handle rests at least along a portion of the opposing uppermost sidewalls of the uppermost pan and the bottom base of the uppermost pan and is further configured to act as a handle when pulled taut.

6. The bundle of pans of claim 5, wherein the adhesive section further extends along the portion of the predetermined length such that each adhesive section further lies over a portion of the ridge of the upper most pan and/or a portion of the opposing uppermost sidewalls.

7. The bundle of pans of claim 5, wherein the un-adhesive portion of the handle include an indicia portion to convey information.

* * * * *